US007395571B2

(12) United States Patent
Van Der Meijden et al.

(10) Patent No.: US 7,395,571 B2
(45) Date of Patent: Jul. 8, 2008

(54) CLEANING OF A SUBMERGED SURFACE

(75) Inventors: Hendrikus Johannes Van Der Meijden, Halfway House (ZA); Michael Edward Moore, Westdene (ZA)

(73) Assignee: Zodiac Pool Care, Inc., Vista, CA (US)

( * ) Notice: Subject to any disclaimer, the term of this patent is extended or adjusted under 35 U.S.C. 154(b) by 796 days.

(21) Appl. No.: 10/490,221

(22) PCT Filed: Sep. 20, 2002

(86) PCT No.: PCT/IB02/03876

§ 371 (c)(1),
(2), (4) Date: Aug. 13, 2004

(87) PCT Pub. No.: WO03/027419

PCT Pub. Date: Apr. 3, 2003

(65) Prior Publication Data

US 2004/0255407 A1 Dec. 23, 2004

(30) Foreign Application Priority Data

Sep. 21, 2001 (ZA) ..... 01/7826

(51) Int. Cl.
*E41H 4/16* (2006.01)

(52) U.S. Cl. ..... 15/1.7; 210/169

(58) Field of Classification Search ..... 15/1.7, 15/347, 246, 246.5; 134/111, 167, 624.4; 210/169; 4/490

See application file for complete search history.

(56) References Cited

U.S. PATENT DOCUMENTS

| | | | | |
|---|---|---|---|---|
| 4,835,809 | A | 6/1989 | Roumagnac | |
| 6,473,928 | B1 * | 11/2002 | Veloskey et al. | 15/1.7 |
| 6,560,808 | B2 * | 5/2003 | Phillipson et al. | 15/1.7 |
| 7,039,980 | B2 * | 5/2006 | Van Der Meyden et al. | 15/1.7 |
| 2002/0170129 | A1 * | 11/2002 | Veloskey et al. | 15/1.7 |
| 2004/0216251 | A1 * | 11/2004 | Van Der Meijden et al. | 15/1.7 |
| 2004/0255407 | A1 * | 12/2004 | Van Der Meijden et al. | 15/1.7 |

FOREIGN PATENT DOCUMENTS

| | | |
|---|---|---|
| WO | WO 99/61727 | 12/1999 |

* cited by examiner

*Primary Examiner*—Lee D Wilson
(74) *Attorney, Agent, or Firm*—Dean W. Russell; Kilpatrick Stockton LLP

(57) ABSTRACT

A pressure type pool cleaner includes a head propelled forwardly over a surface. Different portions of water pumped to the head inducts debris into a cleaner system, and is ejected via a thrust nozzle onto a deflector and thence along a thrust line to thrust the head along the line. The deflector is pivotal via a saddle about a longitudinal axis such as to be displaced laterally relative to the thrust nozzle. The deflector includes obliquely opposed deflection surfaces which are respectively aligned with the nozzle in dependence on its relatively laterally displaced position to deflect the water ejected along the line to respectively different oblique directions to adjust the direction of thrust and to effect lateral steering.

20 Claims, 7 Drawing Sheets

CLEANING OF A SUBMERGED SURFACE

CROSS-REFERENCE TO RELATED APPLICATIONS

This application is the U.S. national phase of International Application No. PCT/IB02/03876 filed on Sep. 20, 2002 and published in English as International Publication No. WO 03/02749 A1 on Apr. 3, 2003, which application claims priority to South African Patent Application No. 2001/7826 filed on Sep. 21, 2001, the contents of which are incorporated by reference herein.

THIS INVENTION relates to cleaning of a submerged surface. It relates more particularly to a method of propelling a pressure-type pool cleaner, and to a pressure-type pool cleaner.

The Applicant expects this invention to be applicable to pool cleaners of the pressure (as opposed to suction) type.

For convenience, for purposes of this specification, terms indicating orientation and direction must be interpreted as referring to a situation in which the pool cleaner moves in a normal direction of travel over a horizontal surface. Thus, a reference to a direction of forward movement of the pool cleaner must be interpreted as the direction of forward movement omitting the effect of steering in accordance with this specification.

In pool cleaners of the pressure type, water is pumped under pressure to a submerged cleaning device or pool cleaner head. In the head, energy associated with the pumped flow stream of water is converted to drive the head over a submerged surface of the pool. In one kind of embodiment, the head has one, or preferably a pair of laterally spaced wheels or rollers. Optionally, energy obtained from the pumped flow stream of water is converted into mechanical energy associated with torque which is applied to the wheels or rollers to propel the pool cleaner. Another method of propulsion is by ejecting a portion of the pumped flow stream of water via a directed nozzle in a predetermined direction to create thrust. In some pool cleaners, these methods of propulsion are combined.

It is to be appreciated that, for various reasons which are well understood in the field of submerged pool cleaners, the head has virtually neutral buoyancy in water, the buoyancy being only slightly negative, ie the head has only a very small weight when submerged.

A problem experienced by the Applicant is that in the kind of pool cleaner to which this invention relates, the pool cleaner tends to move in relatively straight lines which can lead to surfaces of the pool not being cleaned.

It is an object of this invention to at least alleviate this problem.

In accordance with a first aspect of the invention, there is provided a method of propelling a pool cleaner of the pressure kind over a surface submerged in a body of water, the method including

- pumping water in a flow stream to a pool cleaner head;
- directing a portion of the pumped flow stream, via a thrust nozzle mounted in fixed orientation on the head, in a thrust jet stream in a predetermined direction;
- deflecting the thrust jet stream, by means of a composite deflector having deflection surfaces at different orientations, into respectively different directions, by moving the composite deflector to present respectively different deflection surfaces to the thrust jet stream.

Moving the composite deflector may be at random, under the influence of external forces acting on the pool cleaner. As the prevailing forces change with time, and, especially, with the position of the pool cleaner, the pool cleaner head is steered, by thus deflecting the thrust jet stream from a straight line course in the forward direction of movement.

Advantageously, the method may include attaching the composite deflector to a fin which is oriented generally in the direction of forward movement of the pool cleaner head and which is hinged about a hinge axis to the pool cleaner head, the fin being biassed by water drag against movement transverse to its orientation and the fin thus biassing the composite deflector against movement transverse to the orientation of the fin. Thus, in use, the transmission to the fin of any force tending to move the head transversely, will be resisted by the fin, resulting in the head moving relative to the fin and thus also relative to the composite deflector, thus bringing another deflection surface in line with the thrust nozzle and thus deflecting the thrust jet stream from its prior direction. The head reacts to the change in direction of the thrust jet stream by itself changing direction or being steered from its prior course.

The hinge axis may lie in a plane coincident with or parallel with the forward direction of movement of the cleaner head, a position of hinging being spaced from said predetermined direction of the thrust jet stream. Such spacing creates a lever action on the composite deflector to move it.

Said plane of the hinge axis may be normal to an attitude of a surface hugging formation of the pool cleaner head, for example normal to a roller axis when the pool cleaner has a pair of co-axial rollers or wheels. The hinge axis may be longitudinal with the direction of forward movement of the head.

Preferably, the method includes limiting hinging of the fin between limits appropriate to ensure positioning of the composite deflector in the thrust jet stream. Thus, there will always be a deflection surface facing the thrust nozzle and thus deflecting the thrust jet stream.

In one method, two of said deflection surfaces of the composite deflector may oppose each other obliquely respectively to deflect the thrust jet stream obliquely toward laterally opposing directions. Obliqueness or slant of each of the respective surfaces may be between 3° and 30° from the plane of the fin to deflect the thrust jet stream accordingly by between 3° and 30°. The obliqueness or slant may be between 50° and 20°, advantageously between 10° and 15° and the deflection correspondingly between 5° and 20°, advantageously between 10° and 15°.

Conveniently, the respective deflection surfaces may interface along a line lying in a plane intersecting the hinge axis and hinging of the fin may be unresisted or unbiassed between limits. The interface may be leading or fronting the composite deflector, thus acting as a watershed. The thrust jet stream then urges the composite deflector to either side, unless the thrust jet stream is perfectly divided which is a theoretical possibility but is not expected ever to happen in practice.

By way of development, said hinge axis may be a steering hinge axis, the method including, in addition, hinging said composite deflector also about a lateral pitching hinge axis and, in response to the cleaner head being checked against an obstacle transverse to said submerged surface, deflecting the thrust jet stream about said lateral pitching hinge axis and thereby causing the cleaner head to perform a pitching motion.

By pitching motion is meant that the cleaner head tilts about a lateral axis, for example when the cleaner head include a pair of co-axial rollers or wheels, pitching is tilting about the roller axis.

In accordance with a second aspect of the invention, there is provided a pool cleaner of the pressure kind for cleaning a surface submerged in a body of water, which pool cleaner includes

- a cleaner head having at least one roller rotatably mounted to the head about a lateral roller axis;
- a conduit for conducting pumped water under pressure in a flow stream to the head;
- at least one induction nozzle in flow communication with said conduit and arranged to direct a portion of the water of said flow stream in correspondingly at least one induction jet stream such as to induce water immediately above the submerged surface, carrying debris from the submerged surface, to flow into a cleaning and straining section;
- a thrust nozzle mounted in fixed orientation to the cleaner head in flow communication with said conduit and arranged to expel a portion of the water of said flow stream in a thrust jet stream in a predetermined direction into the body of water to generate thrust to propel the cleaner head through the body of water;
- a composite deflector having deflection surfaces at different orientations, the deflector being mounted to the cleaner head for limited movement generally in line with the thrust nozzle to present respectively different deflection surfaces to the thrust jet stream.

In one embodiment two of the deflection surfaces of the composite deflector may oppose each other obliquely, said two deflection surfaces being oriented to deflect the thrust jet stream in use respectively toward laterally opposing directions, i.e. to deviate from the orientation of the thrust nozzle toward laterally opposing directions.

Mounting the composite deflector to the head may be for unresisted movement or unbiassed movement between limits, the limits being adapted to maintain the deflector in the thrust jet stream. Thus, the composite deflector is prevented from escaping from the thrust jet stream which is then always impinging on one or other of the deflection surfaces.

In one species of embodiment, the deflector may be fast with a fin mounted on the head, the fin being oriented generally in the direction of forward movement on the head. The fin may be hinged about a hinge axis between limits to provide said mounting of the composite deflector for unresisted or unbiassed movement between limits about the hinge axis. The hinge axis may lie in a plane coincident with the direction of forward movement of the head, the position of hinging being spaced from said predetermined direction of the thrust jet stream. Said plane, in which the hinge axis lies, may be normal to an attitude of a surface hugging formation of the pool cleaner head. The hinge axis may be normal to the roller axis of the pool cleaner.

The respective deflection surfaces may interface along a line in a plane intersecting the hinge axis.

By way of development, said hinge axis may be a steering hinge axis, the composite deflector being hinged also about a lateral pitching hinge axis, the pool cleaner including a director arranged, in response to the cleaner head being checked against an obstacle transverse to said submerged surface, to deflect the thrust jet stream by means of said composite deflector about said lateral pitching axis, thereby to cause the cleaner head to perform a pitching motion.

The invention will now be described, by way of example, with reference to the accompanying diagrammatic drawings.

Figure 1:
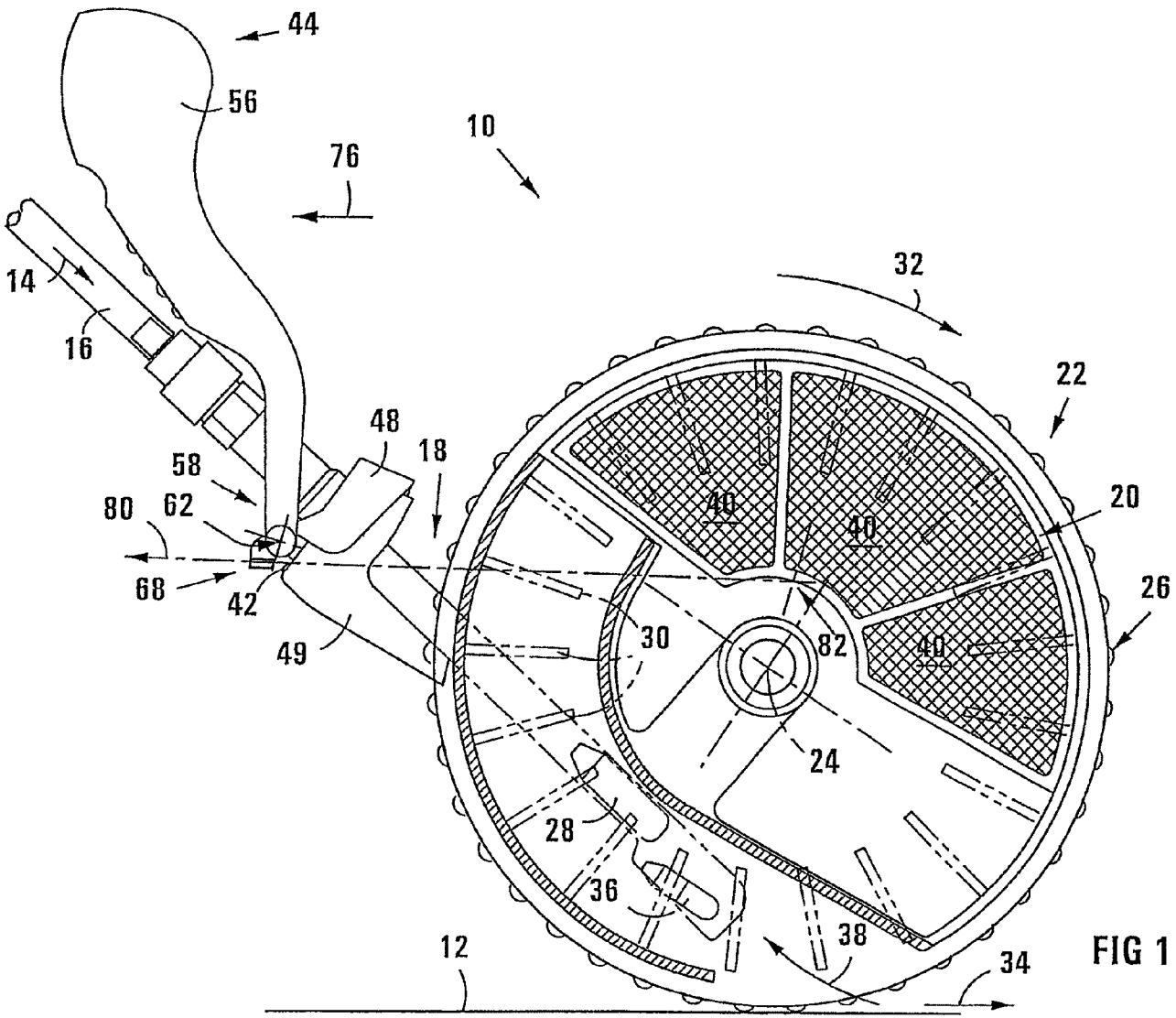
FIG. 1 shows, in part sectional side view, a pool cleaner in accordance with the invention, one wheel being removed to show the underlying structure.
Figure 2:
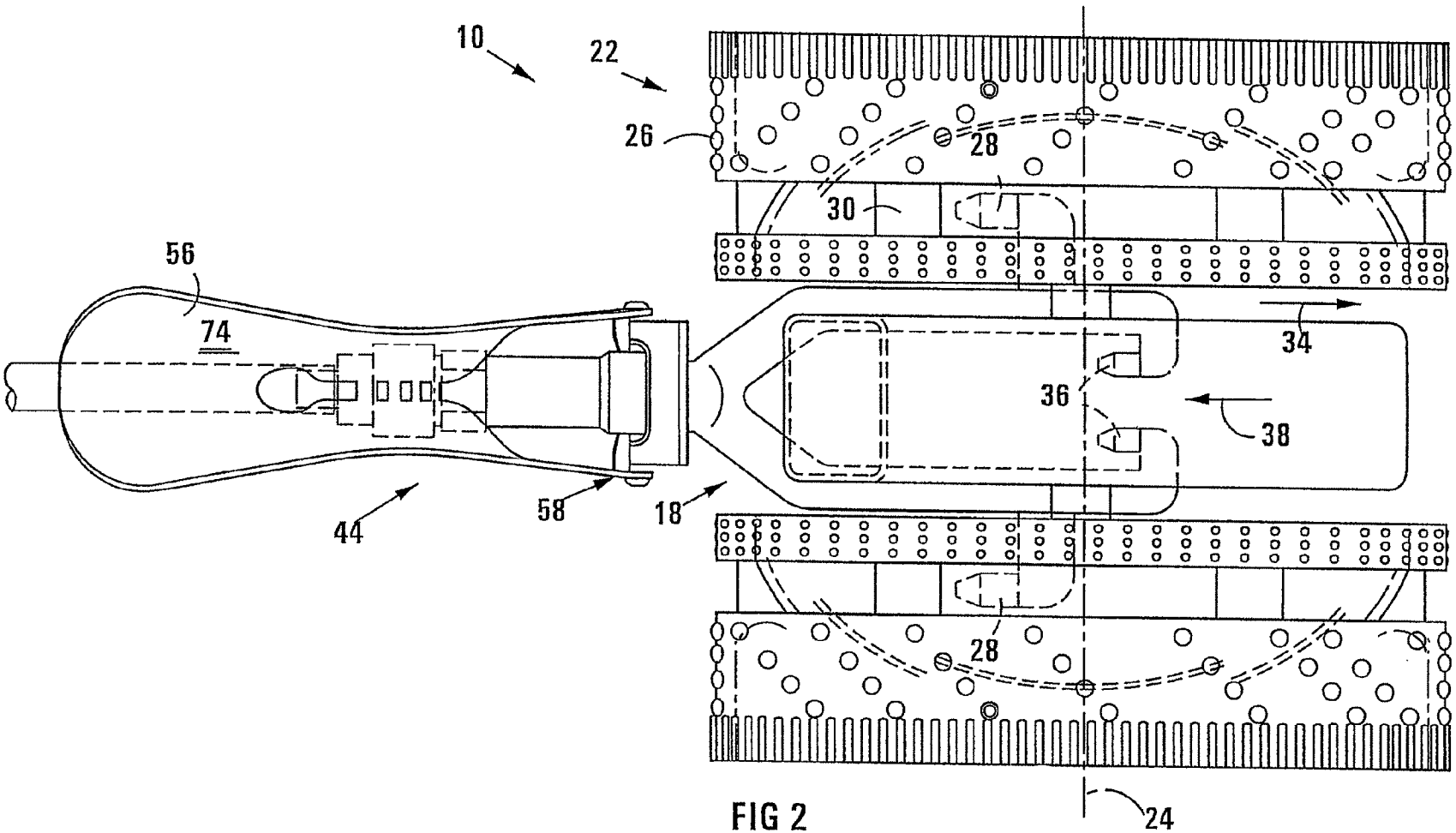
FIG. 2 shows a top plan view of the pool cleaner.

With reference to FIGS. 1 to 6 of the drawings, a pool cleaner of the pressure kind in accordance with the invention comprises a pool cleaner head generally indicated by reference numeral 10 which is propelled over a submerged surface 12, for example a floor of a swimming pool. Water is pumped in a flow stream 14 along a conduit 16 to the head 10.

The head 10 comprises a body generally indicated by reference numeral 20 and including a pair of drive wheels 22 rotatably mounted to the body 20 for rotation about a lateral drive wheel axis 24. (One of the wheels has been removed in FIG. 1 to show obscured structure). The drive wheels 22 have treads 26 of a resilient synthetic polymeric material, which treads have a coarse outer surface to enhance traction between the wheels and the submerged surface 12. In other embodiments, the wheels are not drive wheels and are freely rollable. Then the axis 24 will be merely a wheel axis.

The flow stream of pumped water 14 is directed via flow passages 18 to various nozzles forming part of the pool cleaner head 10.

The nozzles of a first pair of drive nozzles 28 are positioned downstream of 180° bends in bifurcation limbs of a flow passage 18 and are directed, oppositely to the initial direction of flow of the flow stream 14, along the conduit 16, at vanes 30 on the insides of the drive wheels 22 to cause jet streams of water to impinge on the vanes 30 to drive the drive wheels 22 in a direction indicated at 32 about the axis 24 and thus to propel the head 10 over the submerged surface 12 as indicated by reference numeral 34. When the wheels are not drive wheels, then no drive nozzles are present and the vanes 30 may be omitted.

A large portion of the flow stream 14 is directed to induction nozzles 36 which, similarly to the drive nozzles 28, reverse the direction of flow to cause a relatively large induction flow into a cleaning and straining section including a separating cavity of the body 20 to induct water from immediately above the submerged surface 12 as indicated by reference numeral 38 into the separating cavity. It is to be appreciated that undesirable matter, such as dust, leaves, and the like, is carried with the inducted water into the separating cavity. Within the body 20, in the separating cavity, the particulate matter is retained behind strainers 40 which allow strained water to return to the body of water within the pool.

A portion of water is also diverted from the flow stream 14 to a thrust nozzle 42 positioned immediately upstream of the bifurcation in the flow passages 18. The thrust nozzle 42 is orientated to direct a jet stream 46 of water generally rearwardly in a longitudinal direction in a plane which is generally perpendicular to the axis 24.

In accordance with the invention, there is provided a director, generally indicated by reference numeral 44, for directing the jet stream 46 exiting the thrust nozzle 42.

Figure 3:
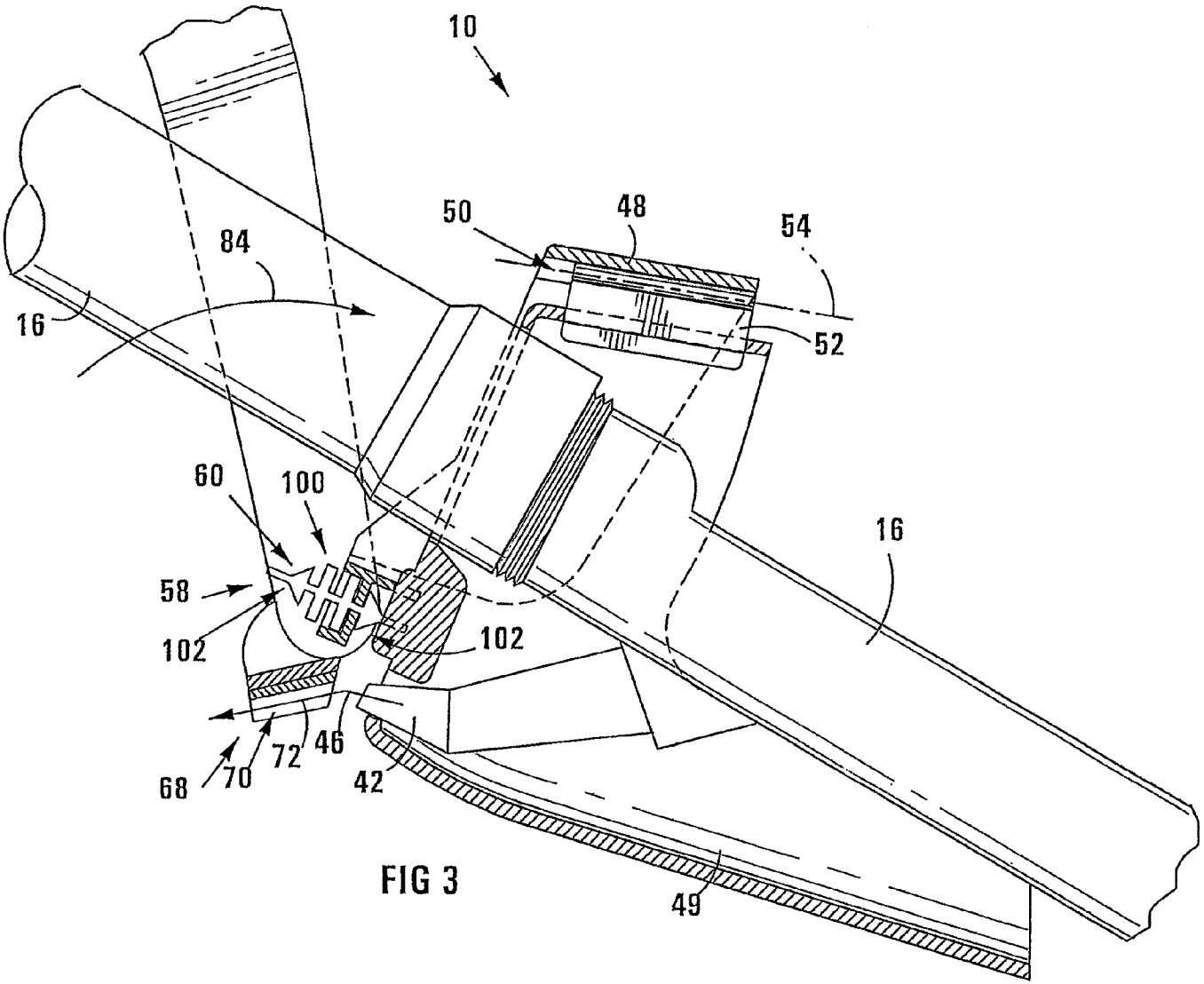
FIG. 3 shows, schematically, to an enlarged scale, a part sectional side view of a thrust nozzle and guide.

The director 44 includes a ring-like or saddle connector 48 which extends with clearance partially around the conduit 16 and is connected indirectly to the body 20 via a mount 49 which is snap-lockingly mounted on the body 20 at a fore end thereof. The connector 48 is connected to the mount 49 and hence to the body 20 by means of a hinge arrangement 50 (FIG. 3). The hinge arrangement 50 includes a first, steering, hinge member 52 which is formed of a synthetic polymeric material and defines a first, steering, hinge axis 54 which extends generally longitudinally.

The director 44 further includes a surface member 56 which is connected to the connector 48 by a second, pitch, hinge arrangement 58 (FIGS. 1 and 3). The second hinge arrangement 58 includes a second, pitch, hinge member 60 of synthetic polymeric material which defines a second, pitch, hinge axis 62 which extends transversely generally parallel with the axis 24.

Figure 6:
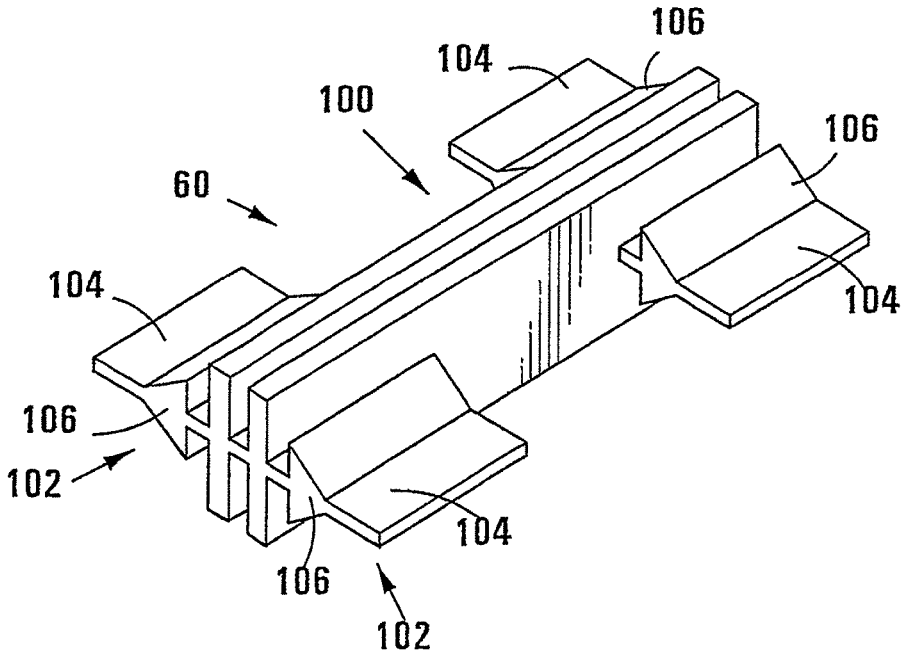
FIG. 6 shows, to an enlarged scale, a three-dimensional view of a hinge member of the pool cleaner.

The pitch hinge member 60 which is shown in FIG. 6 of the drawings, is resiliently flexible and includes a generally H-shaped central section 100 and four outwardly projecting locating formations 102 arranged in opposed pairs. Each locating formation 102 includes a tongue 104 and a retaining insert 106. The inserts 106 protrude from the respective tongues 104 in opposite directions. The tongues 104 on one side of the central section 100 are receivable in complementary slots in the connector 48. The tongues 104 on the other side of the central section 100 are receivable in complementary slots in the surface member 56, the inserts 106 serving to retain the tongues in position in the associated slots. To this end, the inserts 106 taper toward the free ends of the tongues 104 to facilitate their insertion into the associated slots.

The hinge members 52, 60 are configured so that relative movement between the connector 48 and the body 20 as well as between the surface member 56 and the connector 48 is primarily about the first, steering, axis 54 and the second, pitch, axis 62 respectively. However, the hinge members 52, 60 may be sufficiently flexible to permit elastic deformation thereof and thereby to permit limited movement among the connector 48, body 20 and surface member 56 other than about the axes 54, 62.

As mentioned above, the connector 48 extends with clearance around the conduit 16. A recess (not shown) is provided in an edge of the connector 48 at a position diametrically opposite to the hinge arrangement 50. A stop 66 is provided on the mount 49 and positioned in the recess to limit the degree of pivoting of the connector 48 about the first, steering, hinge axis 54, ie in the direction of arrow 55 (FIG. 5).

Figure 5:
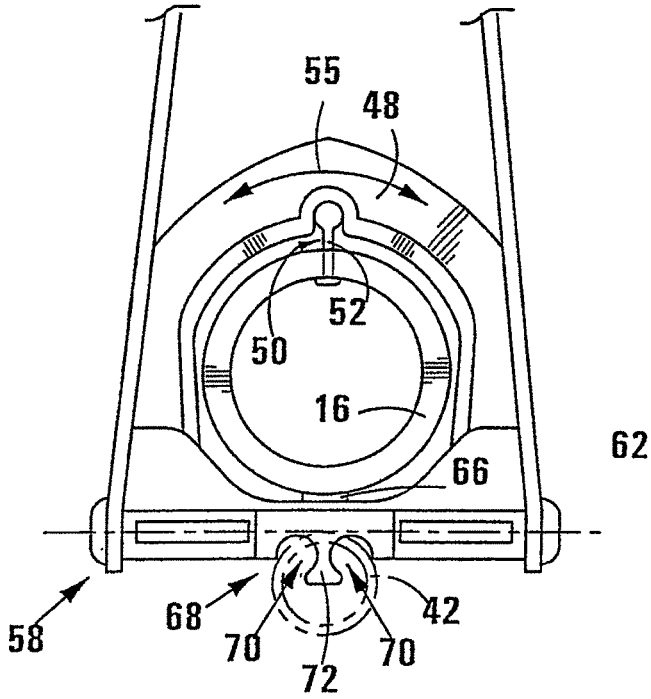
FIG. 5 shows, to an enlarged scale, a sectional view taken at V-V in FIG. 4.

With reference especially to FIGS. 1, 3 and 5, a composite deflector 68 is provided on the surface member 56 at a fore, lower end thereof. The composite deflector 68 defines a pair of laterally spaced deflection surfaces in the form of inverted channels 70, of semi-circular section and of short length. The deflection surfaces 70 diverge away from leading ends thereof and are separated by a partition 72. The width of the partition increases rearwardly, ie away from the nozzle 42, and commensurately with divergence of the deflection surfaces 70.

Figure 4:
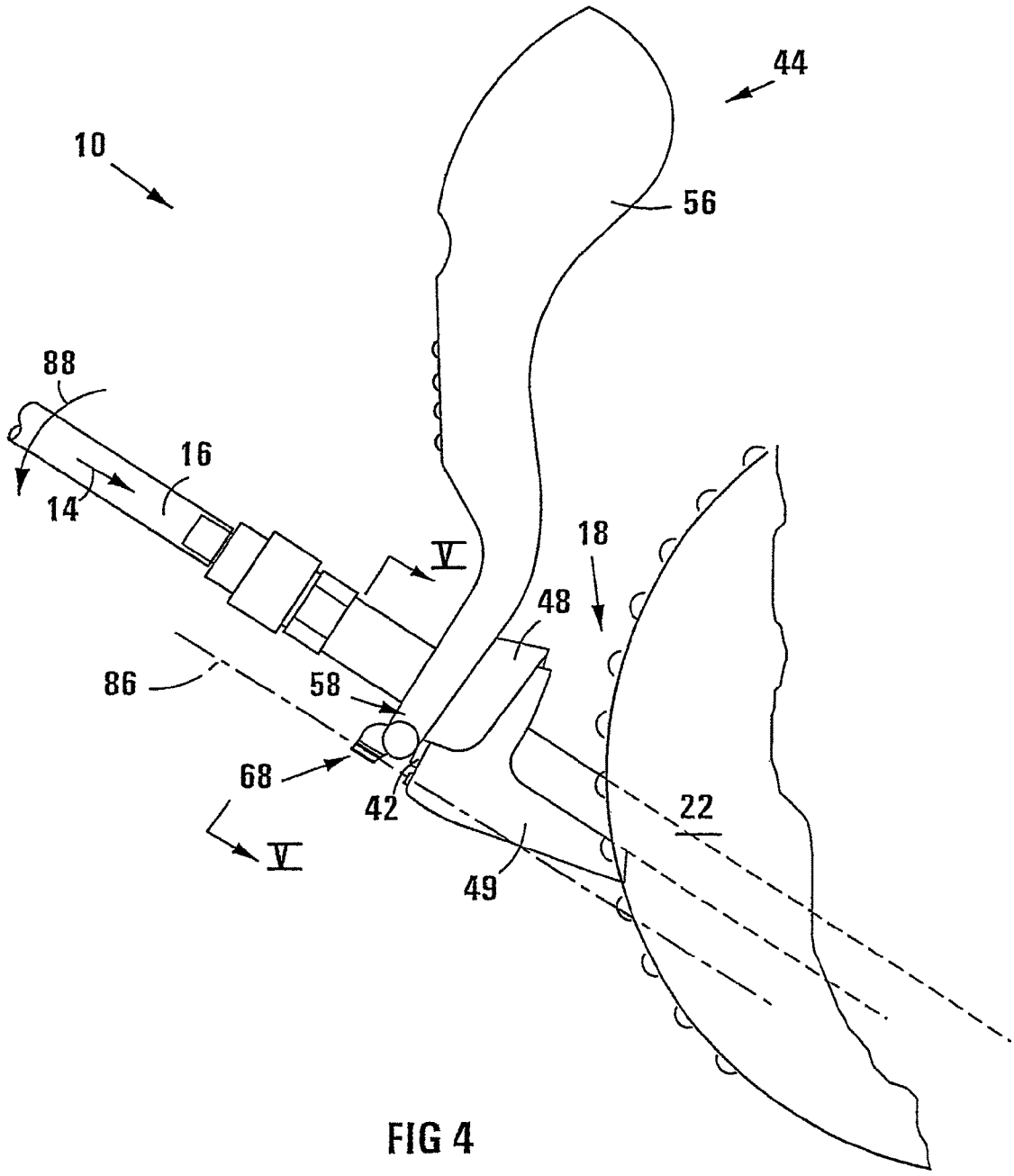
FIG. 4 shows, in a fragmentary view to an enlarged scale, corresponding to FIG. 1, the pool cleaner when it has been stopped against an obstacle.

The surface member 56 defines a relatively large surface 74 which is exposed (sail fashion or air-brake fashion) to water flow, generally indicated by reference numeral 76, when the head 10 moves forward in the direction 34. It is to be appreciated that the surface 74 is in fact moved through the water which is generally stationary, but relative flow takes place applying a force in the direction 76 on the surface 74. Such force is transferred by lever action to the guide 68 to maintain the composite deflector 68, against a bias described below, in its orientation which is its first orientation as shown in FIG. 1. Sides of the surface member 56, as can best be perceived from FIGS. 1 and 4, are oriented in the general direction of forward motion of the cleaner and form fins in accordance with the invention. The fin formations, because of water drag, resist lateral movement of the surface member 56. The significance of this will be explained below.

In this orientation, the composite deflector 68 serves to deflect water from the thrust nozzle 42 as shown at 46 in FIG. 1, causing thrust to be imparted to the head 10 along a first line 80. It is important to appreciate, as shown in FIG. 1, that the first thrust line 80 passes above the lateral drive wheel axis 24 as indicated by reference numeral 82.

It will be appreciated that the flow of water exiting the thrust nozzle 42 impinges on the guide 68 where the water enters the deflection surfaces 70 and the composite deflector 68 (and with it the surface member 56) is deflected or biassed generally about axis 62. In addition, the provision of the partition 72 and deflection surfaces 70 serves to split the flow into two streams which are directed obliquely outwardly at small angles which, in this embodiment, are about 12,5° each. Provided that equal volumes of water flow in each of the deflection surfaces 70 the lateral components of thrust of the water flowing in the channels 70 are balanced so that the net thrust is along the first thrust line 80.

If, however, the director 44 is relatively displaced about the first, steering, hinge axis 54 then the composite deflector 68 will be displaced (by being pivoted) laterally between limits, relative to the thrust nozzle 42 so that a greater volume of water flows through one of the deflection surfaces 70. This results in the lateral components of thrust being uneven with a net lateral component of thrust being applied to the body 20 which results in a steering action causing the body to turn left or right as the case may be. More accurately, the Applicant believes that the mechanism is that the surface member 56, because of the fin action described above, will be relatively stable in lateral direction. Thus, when forces acting on the head change, for example when the head encounters an obstacle such as a wall or step, the head can roll easily about a longitudinal axis causing the thrust nozzle 42 to move laterally.

Furthermore, the Applicant expects the thrust nozzle and the composite deflector to be in perfect alignment very rarely if ever, and that the composite deflector would generally always be in either of the limit positions, álá a toggle switch or "over centre" switch.

Naturally, the water from the thrust nozzle 42 impinging on the composite deflector 68 biasses the director 44 in the direction of arrow 84 (FIG. 3). This is balanced by the force of water acting on the surface member 56 thereby retaining the director 44 in the position shown in FIG. 1 of the drawings. In the event that forward motion in the direction of arrow 34 of the head 10 is halted or checked, more specifically by means of an obstacle such as a wall transverse to the direction of forward motion 34, the relative water flow 76 against the surface 74 terminates and thus the force maintaining the position of the composite deflector 68 against the bias of the jet stream 46 mentioned above also terminates. Consequently, the director 44 tilts forward under the bias and in the direction of the bias as shown at 84. Thus, orientation of the composite deflector 68 changes from the orientation shown in FIG. 1 and which orientation establishes the orientation of the first thrust line 80, to a second orientation shown in FIG. 4. Thus, the jet stream causes a thrust to be applied to the pool cleaner 10 along a second thrust line 86. The second thrust line 86 extends in a direction which causes it to pass remotely from the lateral drive wheel axis 24, ie close to an interface between the tread 26 and the submerged surface 12. Such thrust thus causes a moment about the axis 24 as shown at 88, which causes the conduit 16 and all of its attachments to rotate about the axis 24 and thus to close onto the surface 12. The thrust line 86 then extends generally parallel to the surface 12 and close to, even very close to, the surface 12. As a result, the head 10 is no longer thrust into a corner, or is no longer thrust to the same degree into the corner, formed between the surface 12 and the obstacle wall. A component of the thrust (i.e. the component of thrust normal to, and toward, the surface 12) opposite to the direction in which the head 10 must move along the obstacle wall is not present or is greatly reduced. Furthermore, the component of force forcing the drive wheels 22 against the obstacle wall is increased, thus increasing the traction of the treads 26 on the obstacle wall and causing the drive wheels 22 to climb along the obstacle wall and thus to take the head 10 out of the corner.

In addition, as mentioned above, should the director 44 be deflected about the first, steering, hinge axis 54, eg as a result of the head 10 coming into contact with an inclined surface, eg a wall of the pool, the first thrust line 80 will be deflected laterally and will tend to bias the head 10 either left or right, depending upon the direction of displacement of the composite deflector 68. The Applicant believes that this is an advantageous way of introducing further possibilities of movement which can be executed by the head.

Figure 7:
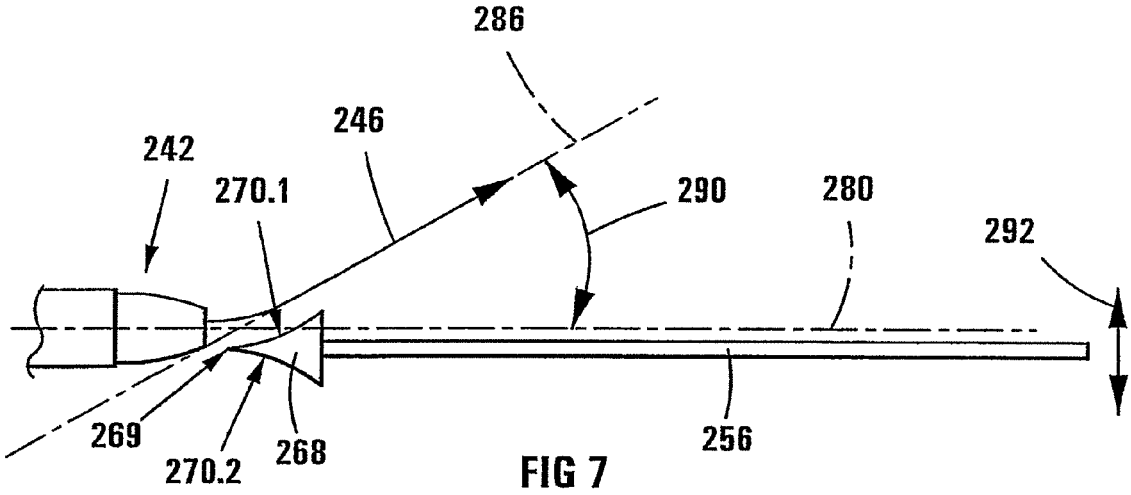
FIG. 7 shows, schematically, in side view, another embodiment of a steering arrangement for a pool cleaner of the general kind described.
Figure 8:
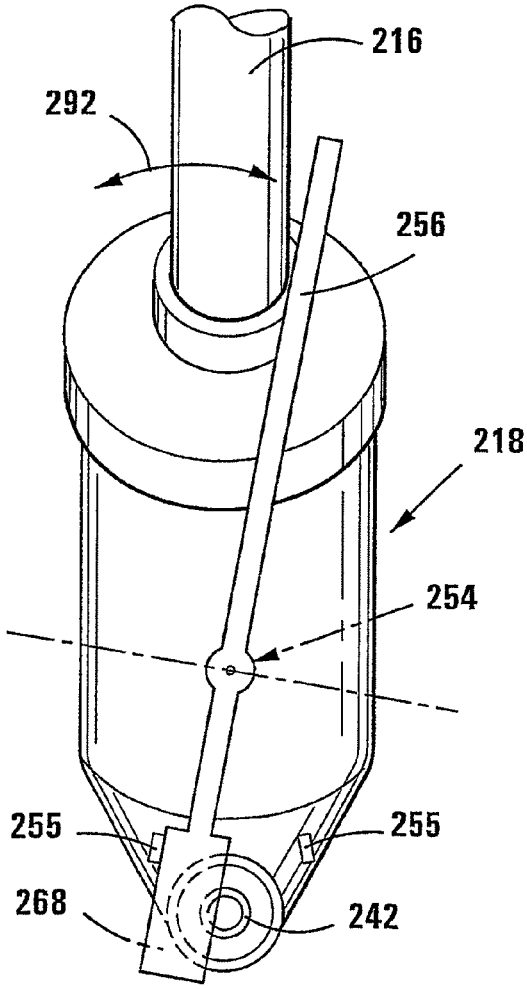
FIGS. 8 and 9 show, schematically, respectively in rear view and in plan view from underneath, the steering arrangement of FIG. 7.
Figure 9:
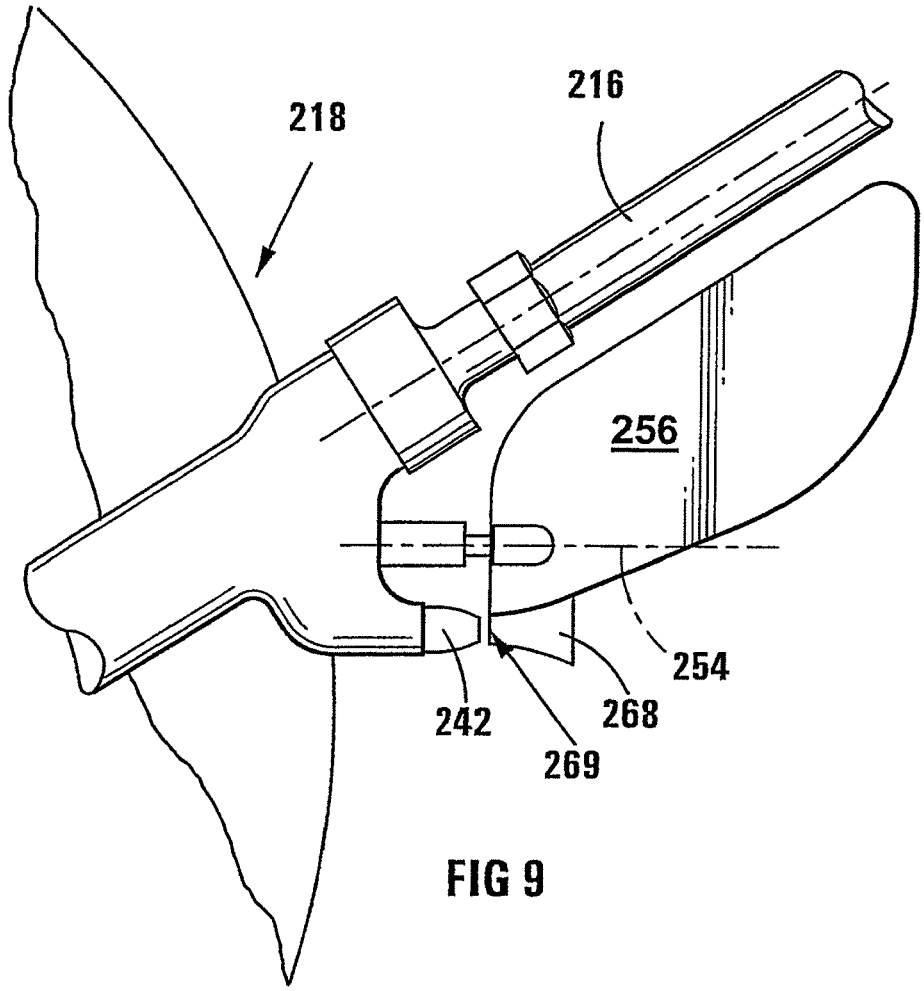

With reference to FIGS. 7, 8 and 9, another embodiment of a pool cleaner steering mechanism is now described. The principles of operation of the steering mechanism remain the same and of the components are similar or identical to the components of FIGS. 1 to 6. Thus, generally, similar reference numerals will be used to indicate similar components or features.

A thrust nozzle 242 of a pool cleaner head ejects water under pressure along an axis 280. Water ejected via the thrust nozzle 242, initially along the axis 280, imparts thrust via the thrust nozzle 242 to the pool cleaner head to propel the pool cleaner head in the forward direction of movement along the axis 280 if the steering effect which is described hereinafter, is not taken into account.

In accordance with the invention, a composite deflector 268 opposes the nozzle 242, and more specifically by means of one deflection surface 270.1, an obliquely opposed deflection surface 270.2 being dormant in the position shown in FIG. 7.

The deflection surfaces 270.1, 270.2 oppose each other obliquely and interface, at a fore end of the deflector 268, in a straight line 269.

The composite deflector 268 is mounted fixedly on a fin 256, the fin, in turn, being hinged about a steering hinge axis 254. In this embodiment, the steering hinge axis 254 is parallel to a forward direction of movement of the pool cleaner head which coincides with the axis 280 of the thrust nozzle 242. It is important to appreciate that the steering axis 254 is laterally spaced from the axis 280 as can best be perceived from FIGS. 8 and 9.

Generally, the hinge axis 254 and the direction of forward movement corresponding to the axis 280 are in the same plane. Thus, the axis 254 could be in any orientation in an upright plane incorporating the axis 280. It is further to be appreciated that, in the event that the pool cleaner body has a pair of co-axial rollers or wheels, the plane including the hinge axis 254 will generally be normal to the wheel or roller axis. It is further to be appreciated that the pool cleaner body will generally have a surface hugging formation which will move closely over a support surface or pool surface being cleaned. Such a formation may, for example, be a mouth of an induction passage via which the induction flow stream is directed. The plane incorporating the hinge axis 254 is generally normal to such surface hugging formation of the pool cleaner head.

Hinging of the fin 256 about the hinge axis 254 is within narrow limits which, in FIG. 8, are schematically indicated by means of limit stops 255. The arrangement of such limit stops 255 is to ensure that the composite deflector 268 does not move entirely out of the influence of the jet stream along the axis 280, i.e. that one of the deflection surfaces will always be aligned with the axis 280. In the embodiment illustrated, it is a theoretical possibility that the interface 269 can be centrally presented to the thrust jet stream and that the thrust jet stream will thus impinge on both of the deflection surfaces 270.1 and 270.2 while the composite deflector 268 is maintained in a central position. However, that is merely a theoretical possibility and it is a condition which is not expected ever to occur in practice. In practice, the jet stream will not be divided 100% symmetrically thus always causing the composite deflector 268 to move to one or the other side and to present only one of the deflection surfaces 270.1, 270.2 to the thrust jet stream. In FIG. 7, it can be seen that under conditions prevalent at a time moment, the deflection surface 270.1 is aligned with the axis 280 and deflects the whole of the thrust jet stream as indicated by reference numeral 246 at an angle indicated by reference numeral 290 from the axis 280.

When conditions change, the deflection surface 270.1 may move out of alignment and the deflection surface 270.2 may then move into alignment with the axis 280 to deflect the thrust jet stream obliquely toward the opposite side of the axis 280. Generally, the limit stops 255 will be symmetrical and the deflection surfaces 270.1, 270.2 will be symmetrical thus resulting in the thrust jet stream being deflected to the one or to the other side of the axis 280 at equal angles. In other embodiments, the arrangement may not be symmetrical. It is contended that the action of the composite deflector 268 can be likened to operation of a toggle switch or over centre mechanism.

It is to be appreciated that the fin 256, in the nature of a fin, is resisted by drag against moving laterally through water. Thus, in the event that external forces act on the pool cleaner head causing it to roll about an axis thereof, or to move laterally, such movement or rolling will be transmitted via the hinge 254 to the fin 256. However, the hinge 254 and the "centre of drag" of the fin do not coincide and, as the fin resists lateral movement, the hinge axis 254 moves with the pool cleaner head, but the centre of drag of the fin resists lateral movement thus causing the fin to hinge about the axis 254 and thus causing the composite deflector 268 to be moved relative to the thrust nozzle 242, indicated at 292. Such relative displacement may cause another deflection surface to be aligned with the axis 280, causing a change in deflection of the thrust jet stream. In this regard, it is to be appreciated that the fin 256, because of the hinge 254 being spaced from the position of the composite deflector 268, operates in the fashion of a lever to displace the composite deflector relative to the thrust nozzle 242.

In this fashion, a further degree of randomness in movement of the pool cleaner head is provided insofar as external forces acting on the pool cleaner head and tending to roll the head or move it laterally, can cause a change in deflection of the thrust jet stream which, in turn, steers the pool cleaner head laterally to one or the other side.

The invention claimed is:

1. A method of propelling a pool cleaner of the pressure kind over a surface submerged in a body of water, the method including pumping water in a flow stream to a pool cleaner head;

directing a portion of the pumped flow stream, via a thrust nozzle mounted in fixed orientation on the head, in a thrust jet stream in a predetermined direction;

deflecting the thrust jet stream, by means of a composite deflector having deflection surfaces at different orientations, into respectively different directions, by moving the composite deflector to present respectively different deflection surfaces to the thrust jet stream.

2. A method as claimed in claim 1 in which moving the composite deflector is at random under the influence of external forces acting on the pool cleaner.

3. A method as claimed in claim 1 which includes attaching the composite deflector to a fin which is oriented generally in a direction of forward movement of the pool cleaner head and which is hinged about a hinge axis to the pool cleaner head, the fin being biassed by water drag against movement transverse to its orientation and the fin biassing the composite deflector against movement transverse to the orientation of the fin.

4. A method as claimed in claim 3 in which the hinge axis lies in a plane coincident with or parallel with a forward direction of movement of the cleaner head, a position of hinging being spaced from said predetermined direction of the thrust jet stream.

5. A method as claimed in claim 4 in which said plane of the hinge axis is normal to an attitude of a surface hugging formation of the pool cleaner head.

6. A method as claimed in claim 3, including limiting hinging of the fin between limits appropriate to ensure positioning of the composite deflector in the thrust jet stream.

7. A method as claimed in claim 6 in which two of said deflection surfaces of the composite deflector oppose each other obliquely respectively to deflect the thrust jet stream obliquely toward laterally opposing directions.

8. A method as claimed in claim 7 in which obliqueness or slant of each of the respective surfaces is between 30° and 30° from the plane of the fin to deflect the thrust jet stream accordingly by between 30° and 30°.

9. A method as claimed in claim 7 in which the respective deflection surfaces interface along a line lying in a plane intersecting the hinge axis.

10. A method as claimed in claim 3 in which hinging of the fin is unresisted or unbiassed between limits.

11. A method as claimed in claim 3 in which said hinge axis is a steering hinge axis, the method including hinging said composite deflector also about a lateral pitching hinge axis and, in response to the cleaner head being checked against an obstacle transverse to said submerged surface, deflecting the thrust jet stream about said lateral pitching hinge axis and thereby causing the cleaner head to perform a pitching motion.

12. A pool cleaner of the pressure kind for cleaning a surface submerged in a body of water, which pool cleaner includes a cleaner head having at least one roller rotatably mounted to the head about a lateral roller axis;

a conduit for conducting pumped water under pressure in a flow stream to the head;

at least one induction nozzle in flow communication with said conduit and arranged to direct a portion of the water of said flow stream in correspondingly at least one induction jet stream such as to induce water immediately above the submerged surface, carrying debris from the submerged surface, to flow into a cleaning and straining section;

a thrust nozzle mounted in fixed orientation to the cleaner head in flow communication with said conduit and arranged to expel a portion of the water of said flow stream in a thrust jet stream in a predetermined direction into the body of water to generate thrust to propel the cleaner head through the body of water;

a composite deflector having deflection surfaces at different orientations, the deflector being mounted to the cleaner head for limited movement generally in line with the thrust nozzle to present respectively different deflection surfaces to the thrust jet stream.

13. A pool cleaner as claimed in claim 12 in which two of the deflection surfaces of the composite deflector oppose each other obliquely and are oriented to deflect the thrust jet stream in use respectively toward laterally opposing directions.

14. A pool cleaner as claimed in claim 12 in which mounting the composite deflector to the head is for unresisted movement or unbiassed movement between limits, the limits being adapted to maintain the deflector in the thrust jet stream.

15. A pool cleaner as claimed in claim 14 in which the deflector is fast with a fin mounted on the head, the fin being oriented generally in the direction of normal forward movement of the head.

16. A pool cleaner as claimed in claim 15 in which the fin is hinged about a hinge axis between limits to provide said mounting of the composite deflector for unresisted or unbiassed movement between limits about the hinge axis.

17. A pool cleaner as claimed in claim 16 in which the hinge axis lies in a plane coincident with the normal direction of forward movement of the head, the position of hinging being spaced from said predetermined direction of the thrust jet stream.

18. A pool cleaner as claimed in claim 17 in which said plane, in which the hinge axis lies, is normal to an attitude of a surface hugging formation of the pool cleaner head.

19. A pool cleaner body as claimed in claim 16 in which the respective deflection surfaces interface along a line in a plane intersecting the hinge axis.

20. A pool cleaner as claimed in claim 16 which said hinge axis is a steering hinge axis, the composite deflector being hinged also about a lateral pitching hinge axis, the pool cleaner including a director arranged, in response to the cleaner head being checked against an obstacle transverse to said submerged surface, to deflect the thrust jet stream by means of said composite deflector about said lateral pitching axis, thereby to cause the cleaner head to perform a pitching motion.

* * * * *